US008733319B2

(12) United States Patent
Takigawa et al.

(10) Patent No.: US 8,733,319 B2
(45) Date of Patent: May 27, 2014

(54) ELECTRONIC GOVERNOR SYSTEM AND CONTROL DEVICE OF THE SAME

(75) Inventors: Buso Takigawa, Kanagawa-ken (JP); Umerujan Sawut, Kanagawa-ken (JP); Tohti Gheyret, Kanagawa-ken (JP); Norichika Kojima, Kanagawa-ken (JP); Tsutomu Murakami, Kanagawa-ken (JP)

(73) Assignee: Nikki Co., Ltd., Atsugi (JP)

( * ) Notice: Subject to any disclaimer, the term of this patent is extended or adjusted under 35 U.S.C. 154(b) by 498 days.

(21) Appl. No.: 13/064,958

(22) Filed: Apr. 28, 2011

(65) Prior Publication Data

US 2012/0000442 A1 Jan. 5, 2012

(30) Foreign Application Priority Data

Apr. 30, 2010 (JP) ..... 2010-105642

(51) Int. Cl.
*F02D 41/00* (2006.01)

(52) U.S. Cl.
USPC ..... 123/360; 123/352; 123/361; 123/399

(58) Field of Classification Search
USPC ..... 123/350, 352, 360, 361, 372, 399, 402, 123/403
See application file for complete search history.

(56) References Cited

U.S. PATENT DOCUMENTS

| | | | | |
|---|---|---|---|---|
| 5,657,737 | A * | 8/1997 | Ishida et al. | 123/674 |
| 6,751,544 | B2 * | 6/2004 | Hashimoto et al. | 701/107 |
| 7,831,372 | B2 * | 11/2010 | Sawut et al. | 701/103 |

FOREIGN PATENT DOCUMENTS

| | | |
|---|---|---|
| JP | 05-240073 | 9/1993 |
| JP | 2003-214234 | 7/2003 |

* cited by examiner

*Primary Examiner* — John Kwon
(74) *Attorney, Agent, or Firm* — Rader, Fishman & Grauer PLLC

(57) ABSTRACT

When control to maintain a constant engine rotation number is executed, the electronic control unit constantly monitors an error of detected throttle position data with respect to a desired throttle control value, executes a first stage of a failure judgment method to judge that a failure of a throttle control system has occurred in a case where an absolute value of the error exceeds a predetermined threshold value continuously for a predetermined time or longer, and executes a second stage of the failure judgment method to judge that a serious failure has occurred in the system in a case where a detected engine rotation number exceeds a predetermined rotation number continuously for a predetermined time or longer, to perform predetermined operations in accordance with the judgment results.

8 Claims, 7 Drawing Sheets

1Aor1C

ELECTRONIC GOVERNOR SYSTEM AND CONTROL DEVICE OF THE SAME

BACKGROUND OF THE INVENTION

1. Field of the Invention

The present invention relates to an electronic governor system in which a control device performs an operation to open and close a throttle valve installed in an air suction system of an engine, thereby maintaining a desired engine rotation number, and the control device of the electronic governor system, and more particularly, it relates to an electronic governor system having a failure diagnosis function of detecting the occurrence of a failure in the system, and a control device of the electronic governor system.

2. Description of Related Art

In recent years, for the purpose of precisely controlling an engine, in place of an operator's accelerator operation to mechanically open and close the throttle valve, there has been spread an electronic governor system in which an electronic control device performs an operation to open and close a throttle valve, thereby controlling an engine rotation number. For example, an electronic governor system 1C having a constitution disclosed in JP-A-5-240073 and shown in FIG. 1 is well known, and has a hardware constitution which is common with an electronic governor system 1A of the present invention described later.

In the conventional electronic governor system 1C, an engine 2 which is a control object is subjected to various controls by an electronic control unit 10C, and a position (an open degree) of a throttle valve 32 incorporated in an electronic control throttle (an electronic governor) 30 disposed in an air suction passage 20 of the engine 2 is adjusted to change the amount of air to be sucked, thereby controlling an output of the engine.

In this case, as to the engine rotation number, an output signal from a crank angle sensor 12 disposed on the side of a crank shaft is taken into the electronic control unit 10C (F), and on the basis of the signal, the electronic control unit 10C operates a throttle actuator 13 for the throttle valve 32 disposed in the electronic control throttle 30, to control the engine rotation number. Moreover, the electronic control throttle 30 is provided with a throttle position sensor 14 so as to obtain positional information of the throttle valve 32, and an output signal from the sensor is also taken into the electronic control unit 10C, to execute control so that an actual engine rotation number converges to a desired constant rotation number on various load conditions.

FIG. 7 shows a simplified constitution of the electronic control throttle 30 seen from an air suction side. The butterfly type throttle valve 32 is disposed in a bore 31 which is an air passage, and a throttle shaft 33 connected to this valve rotates in a range of 90° around the shaft, to change a size of a space formed between the inner peripheral surface of the bore 31 and the throttle valve 32, thereby adjusting an air flow rate. Moreover, the throttle shaft 33 is connected to the throttle actuator 13 of a rotary driving system via gears 37, 38 and 39.

In the throttle actuator 13, a DC brush motor is usually used, and the electronic control unit 10C allows an arbitrary current to flow in a forward/backward direction on the basis of a pulse width modulation signal involving a polarity change (PWM excitation), thereby performing an operation to open and close the throttle valve 32. Moreover, when a target 34 attached to the end face of the throttle shaft 33 is detected by an encoder 35, the positional information of the throttle valve 32 is obtained, whereby servo control is executed so that an arbitrary throttle position is obtained on the basis of this positional information. It is to be noted that for the purpose of securing safety, a return spring 36 is disposed in the throttle shaft 33, and the throttle valve 32 is operated in a totally closed direction while the throttle actuator 13 is not operated owing to a failure or the like.

FIG. 8 shows an example of a control block diagram by software of the electronic control unit 10C which controls such hardware. P1 and P2 show plants (simulation models) of the throttle valve 32 and the engine 2. When the unit is actually operated, these plants become control objects, and these operation results are input into the electronic control unit 10C as an actual throttle position (θe) and an actual engine rotation number (Ne) in accordance with sensor outputs.

In a specific method of constantly executing the control in accordance with a desired arbitrary engine rotation number (Nd) on the basis of the above information, an error (Nerr) of the actual engine rotation number (Ne) with respect to the desired engine rotation number is calculated, and on the basis of this result, a block C2 of rotation number feedback control usually calculates a desired throttle position (θd). An error (θerr) of the actual throttle position (θe) with respect to this desired throttle position is calculated, and on the basis of this result, a block C1 of the feedback control obtains the throttle position, to calculate a control amount (U) of the throttle actuator 13. Then, when the throttle actuator 13 is driven on the basis of this control amount (U), the throttle position (θe) changes, and the amount of the air to be sucked changes, to increase or decrease a torque generated in the engine 2.

Moreover, various disturbance load torques (Tad) are added to the engine 2, but in accordance with a balance between these torques and the torque generated in the engine 2, the engine rotation number (Ne) is finally determined. Then, this engine rotation number (Ne) information is input into the block C2 for the rotation number control, and such a feedback control system executes the control so that the engine rotation number constantly converges to the desired engine rotation number (Nd). It is to be noted that in each feedback control calculation processing, an operation for allowing each error to converge to zero is performed, and in this operation, PID control, sliding mode control or the like is used.

However, in such conventional control, the failure of each sensor, the throttle actuator 13 or the like is not taken into consideration, and there has been a problem that if the failure occurs in each portion, the control becomes unstable, thereby causing engine stall, engine runaway or the like. To solve the problem, for example, as in a control device of an electronic governor system disclosed in JP-A-2003-214234, when a state where an absolute value of an error of a detected actual throttle open degree with respect to a desired throttle open degree is not less than a predetermined value continues for a predetermined time or longer, it is judged that the failure has occurred in a throttle control system.

However, even in a case where the failure of the throttle control system only is detected in this manner, if a failure occurs in another portion of the system, for example, as in the failure of the engine, this failure cannot be detected, whereby safety in the system is not sufficiently secured. Moreover, in the case of a serious failure involving the runaway, a failsafe control function to avoid at least the worst situation is preferably automatically exerted.

SUMMARY OF THE INVENTION

The present invention has been developed to solve the above problem, and an object thereof is to provide an electronic governor system in which the occurrence of a failure is accurately detected, whereby safety in the system can sufficiently be secured.

To achieve the object, according to the present invention, there is provided an electronic governor system comprising: an electronic control throttle including an actuator driving type throttle valve and a throttle position sensor; an engine rotation number sensor; and a control device which performs an operation to open and close the throttle valve in accordance with an engine operation state while detecting at least an output signal from the throttle position sensor and an output signal from the engine rotation number sensor, to maintain a desired engine rotation number, characterized in that the control device performs a first failure judgment method to constantly monitor an error of detected throttle position data with respect to a desired throttle control value and judge that a failure of a throttle control system has occurred in a case where an absolute value of this error exceeds a predetermined threshold value continuously for a predetermined time or longer, and the control device performs a second failure judgment method to judge that a serious failure has occurred in the system in a case where a detected engine rotation number exceeds a predetermined rotation number continuously for a predetermined time or longer, to perform predetermined operations in accordance with the judgment results.

In this manner, in the electronic governor system, the control device judges the occurrence of the failure (a defect) of the throttle control system while monitoring the error of the throttle position data with respect to the desired throttle control value. Additionally, the control device judges the occurrence of the serious failure in the system in a case where the engine rotation number exceeds a predetermined rotation number as an upper limit value or the like for securing safety continuously for a predetermined time or longer, thereby executing a procedure which is necessary in accordance with failure contents. In consequence, the safety of the system can sufficiently easily be secured.

Moreover, this electronic governor system is characterized in that during the operation in the case where it is judged by the first failure judgment method that the failure has occurred, the control device stops energization of an actuator of the throttle valve, and moves the throttle valve in a closing direction by a return spring attached to a throttle shaft, to lower the engine rotation number, whereby it is possible to securely construct a failsafe mechanism which avoids the runaway of the engine with a simple constitution.

Furthermore, in the above electronic governor system, during the operation in the case where it is judged by the second failure judgment method that the failure has occurred, the control device performs at least one of stop of energization of an ignition coil, stop of energization of a fuel injection valve and stop of supply of a fuel, to emergently stop the engine, whereby even when a serious failure occurs in the system, it is possible to securely avoid a serious situation due to the engine runaway or the like.

In addition, the above electronic governor system further comprises failure notification means, and during the operation in the case where it is judged that the failure has occurred, the control device notifies, via the failure notification means, an operator of at least one of the occurrence of the failure and a position of the failure, whereby when the failure of the system occurs, the operator can easily take an accurate action. In this case, the failure notification means is a failure display lamp, and the control device controls the energization so as to obtain a lighting situation which varies with contents of the judgment of the occurrence of the failure, whereby the operator can easily recognize the failure contents with a simple constitution.

Additionally, there is provided a control device in which a control program for an electronic control throttle is stored and which is disposed in the above electronic governor system to execute the control contents, whereby when this control device is only applied to the usual electronic governor system, the above functions can be realized.

EFFECT OF THE INVENTION

According to the present invention, it is judged that a failure of a throttle control system has occurred, from an error of a throttle position with respect to a desired throttle control value, and additionally, it is judged that a serious failure in the system has occurred in a case where an engine rotation number exceeds a predetermined rotation number continuously for a predetermined time or longer, whereby the occurrence of the failure is accurately detected, and safety in the system can sufficiently be secured.

DESCRIPTION OF THE PREFERRED EMBODIMENTS

Hereinafter, the best mode for carrying out the present invention will be described with reference to the drawings.

Figure 1:
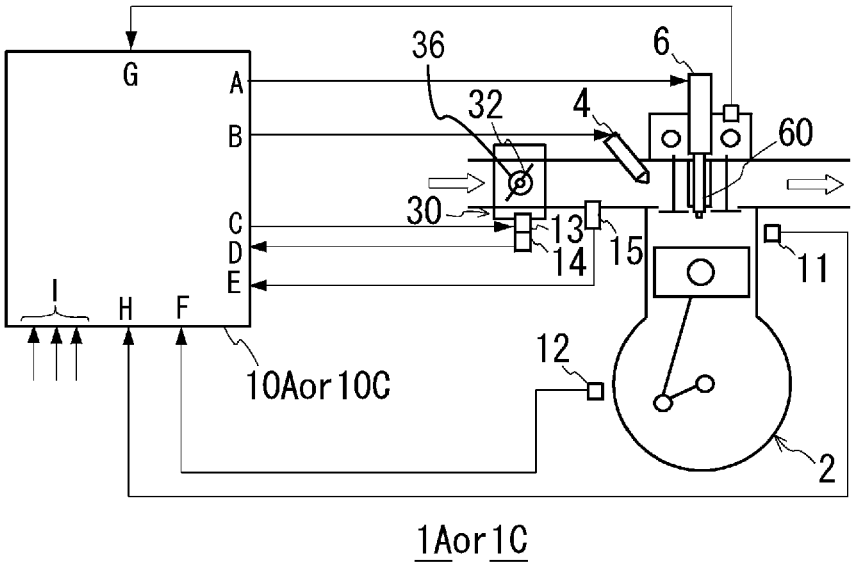
FIG. 1 is an arrangement diagram showing a hardware constitution of an electronic governor system which is common with the present invention and a conventional example.
Figure 7:
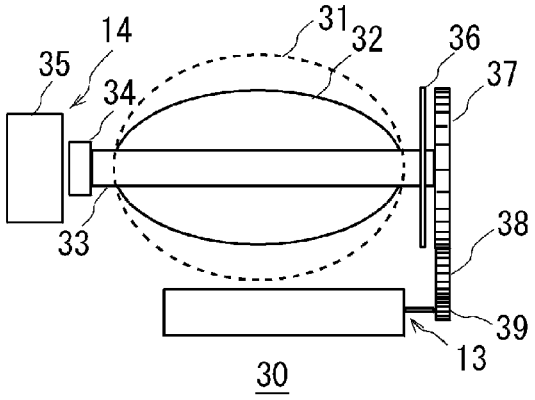
FIG.7 PRIOR ART
FIG. 7 is a control block diagram according to a conventional example.

FIG. 1 shows a hardware constitution of an electronic governor system 1A of the present embodiment. This system has the same hardware constitution as the above conventional system, and an electronic control throttle 30 of the system also has a constitution which is common with the conventional constitution shown in FIG. 7, but the system is executed by an electronic control unit 10A which is a control device for performing an operation to open and close a throttle valve 32.

That is, when control to maintain a constant engine rotation number is executed, the electronic control unit 10A constantly monitors an error of detected throttle position data with respect to a desired throttle control value, executes a first stage of a failure judgment method to judge that a failure of a throttle control system has occurred in a case where an absolute value of the error exceeds a predetermined threshold value continuously for a predetermined time or longer, and executes a second stage of the failure judgment method to judge that a serious failure has occurred in the system in a case where a detected engine rotation number exceeds a predetermined rotation number continuously for a predetermined time or longer, to perform predetermined operations in accordance with the judgment results.

It is to be noted that in the electronic control unit 10A, a program for executing a control method of the electronic governor system as follows is additionally stored in storage means of the electronic control unit which performs a usual throttle opening/closing operation. The electronic control unit 10A is disposed for exclusive use in the electronic governor system 1A, but the function of the electronic control unit may be performed by an electronic control device which executes another engine control.

Figure 2:
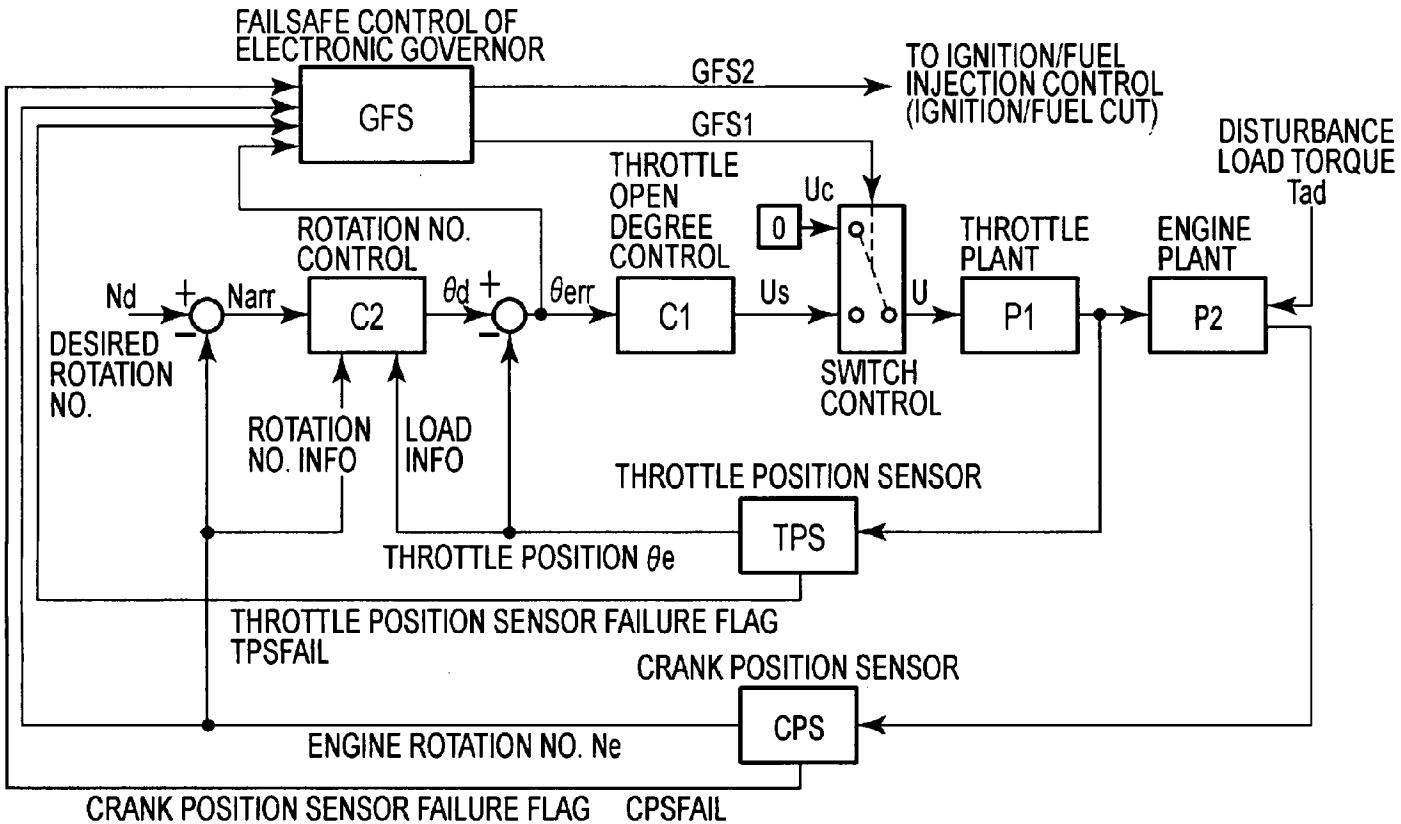
FIG. 2 is a control block diagram of an electronic control unit of FIG. 1.
Figure 8:
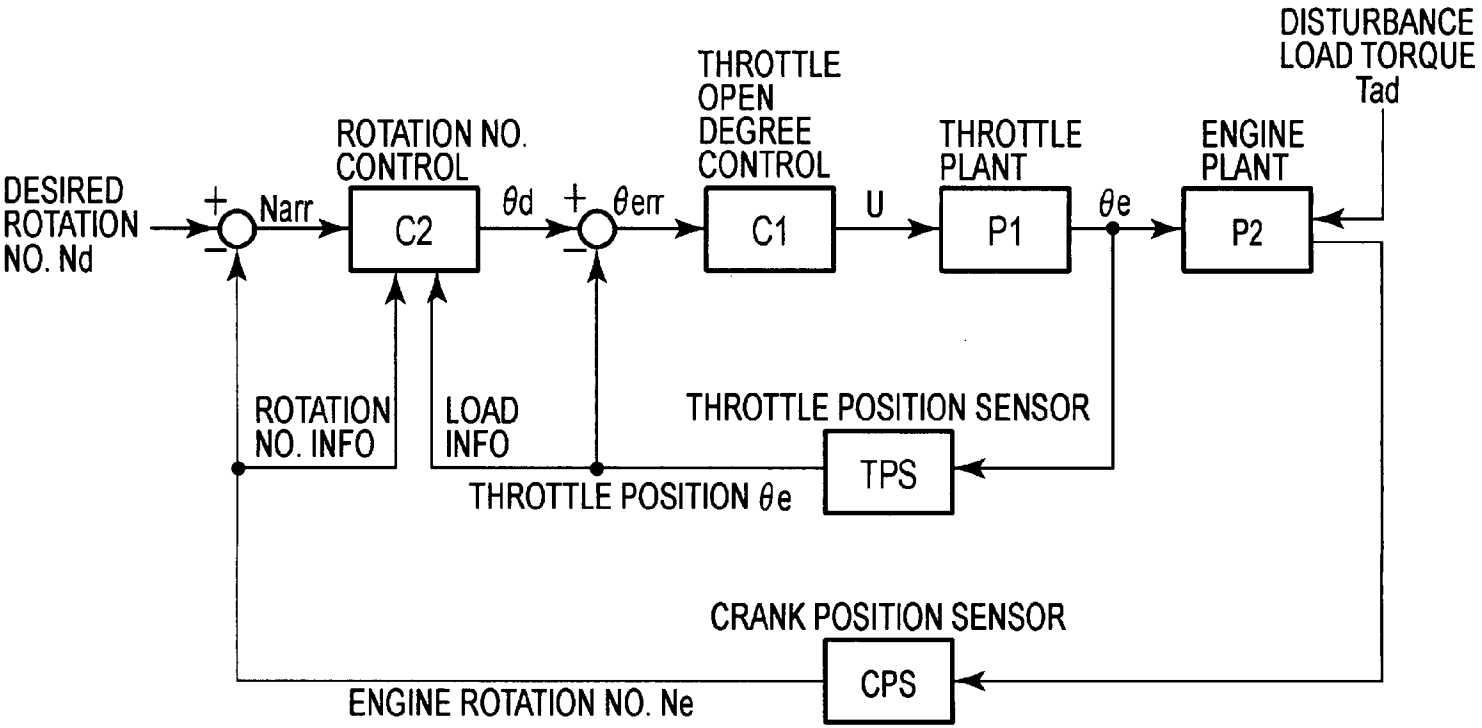
FIG.8 PRIOR ART
FIG. 8 is a graph showing an example of an operation according to the conventional example.

FIG. 2 shows a control block diagram of the electronic control unit 10A of the electronic governor system 1A according to the present embodiment. In this system, a switch control function of a calculation output value Us of a block C1 of throttle position control is added to a block diagram of FIG. 8 showing a conventional example. This switch control performs processing to select Uc as a control input (U) into a throttle actuator 13, when a flag is 0.

Figure 3:
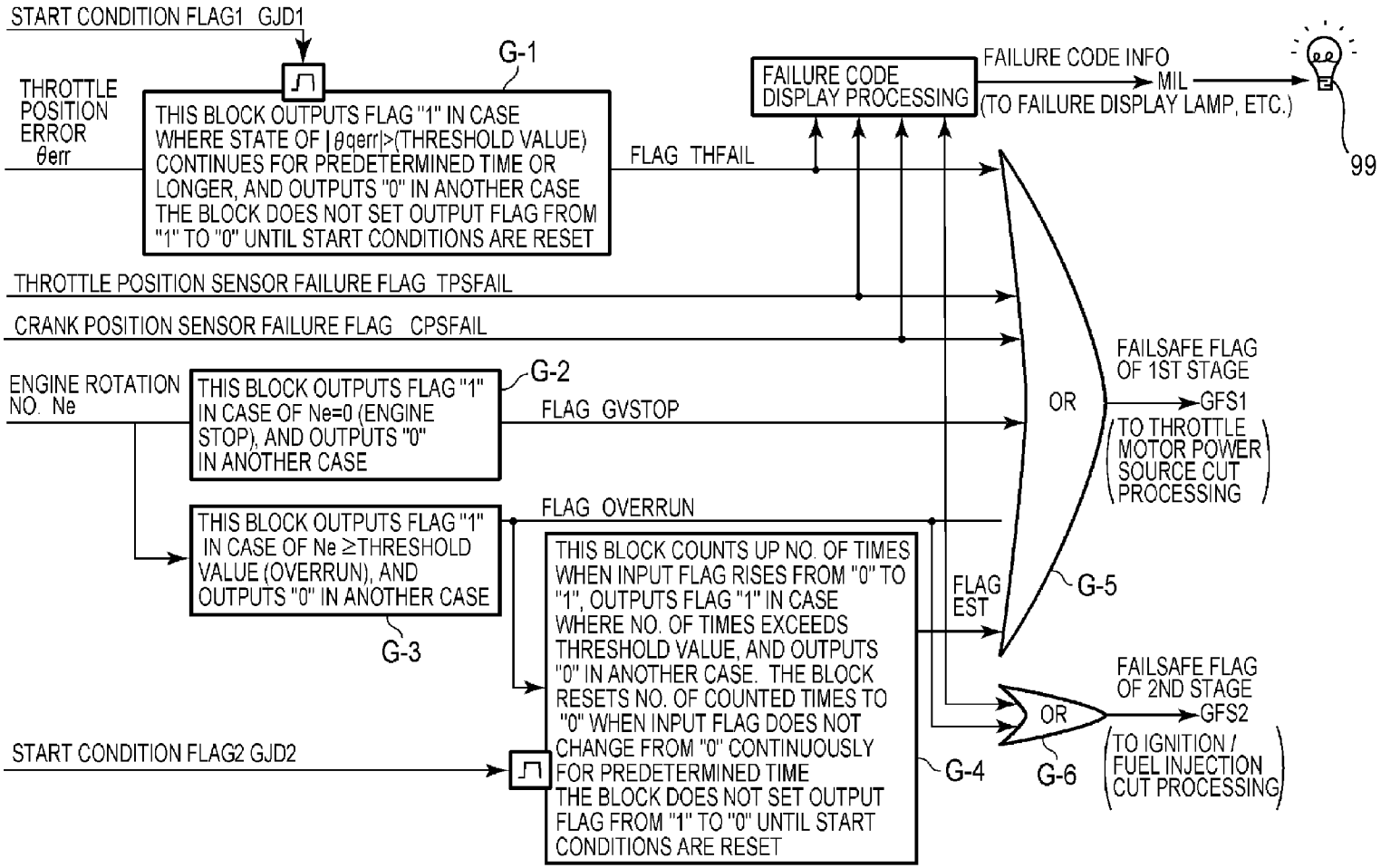
FIG. 3 is a control block diagram showing details of a failsafe control part of the electronic control unit of FIG. 2.

This Uc is a fixed value of 0. Moreover, a failsafe control flag GFS1 of the first stage is flag information output from a block GSF which performs failsafe control judgment. Hereinafter, the block GSF for this failsafe control judgment will be described in detail with reference to FIG. 3.

The first stage of the failure judgment method of the electronic governor system 1A will be described. When a start condition flag 1 (GJD1) is established, a throttle operation trouble judgment block G-1 starts. This block performs such processing that when an absolute value of a throttle position error (θerr) exceeds a predetermined threshold value and this state continues for a predetermined time or longer, it is supposed and judged that "an operation defect is generated in a throttle mechanism owing to delay, adherence or the like", to set a flag THFAIL to 1.

When the flag THFAIL is 1, the failsafe control flag GFS1 of the first stage is set to 1, and the control input (U) of the throttle actuator 13 is set to 0 by the method described above with reference to FIG. 3, to cut a driving power source, whereby an only torque in a valve closing direction by a return spring disposed in a throttle shaft 33 acts so that the throttle valve 32 returns to a totally closed state.

In consequence, safe control (hereinafter referred to as "the governor cut control") is executed to lower the engine rotation number, thereby preventing the runaway of an engine in advance. In accordance with the failsafe control flag GFS1 of the first stage, there is obtained a logical sum G-5 of all pieces of information on a failure flag TPSFAIL of a throttle position sensor 14, a failure flag CPSFAIL of a crank angle sensor 12, a flag OVERRUN described later and a flag EST in addition to the flag THFAIL. Even when the throttle position control has only little risk, the governor cut control is executed as early as possible, thereby further improving safety in this logical structure.

Moreover, the start condition flag 1 (GJD1) is set to 0 in an engine stop state or in a state where a power source voltage is unstable before or after the start of the engine, but the flat is set to 1 in another state where an engine 2 rotates. In consequence, the stability of a throttle operation is monitored as constantly as possible while eliminating an erroneous diagnosis element.

Next, the second stage of the failure judgment in the electronic governor system 1A will be described. The engine rotation number (Ne) is constantly monitored, and when the rotation number exceeds the maximum allowable rotation number of the engine 2, processing G-3 is performed to set the flag OVERRUN to 1. The flag OVERRUN is executed to protect the engine 2 from overrun, to perform the governor cut operation by the logical sum processing G-5. Moreover, through another logical sum processing G-6, processing is performed to set a flag GFS2 of the failsafe control of the second stage to 1.

When the flag GFS2 is 1, an operation to cut fuel injection or ignition output is performed. In consequence, the generated torque of the engine 2 is eliminated, and the engine rotation number can rapidly be lowered. Then, in a case where the engine rotation number is not more than the predetermined maximum allowable rotation number, the flag OVERRUN is set to 0, whereby the governor cut operation, the fuel injection cut operation or the ignition cut operation is discontinued, thereby returning to a usual state.

Moreover, when a start condition flag 2 (GJD2) is established and the system encounters a situation in which a state where the flag OVERRUN is set from 0 to 1 occurs frequently for a short time, processing G-4 to set the flag EST to 1 is performed. A state where the flag EST is set to 1 means that "a serious defect has been generated in the electronic governor system 1A owing to the drop-out of the throttle valve 32, the breakage of the return spring or the like." The electronic control unit performs the above processing of the flag OVERRUN and the logical sum G-6, thereby setting the failsafe control flag GFS2 of the second stage to 1.

It is to be noted that when an ignition key is turned on, the start condition flag 2 (GJD2) is set from 0 to 1, and the flag is not reset to 0 until the ignition key is turned off. Therefore, the electronic control unit has a logical structure in which the flag EST is not reset to 0 until the control block G-4 resets the start condition flag 2 (GJD2) to 0. In consequence, when the ignition/fuel cut function is once performed in accordance with the flag EST, this state is maintained until the ignition key is turned on again.

Another safety measure has a logical structure including processing G-2 to set a flag GVSTOP to 1, when the engine rotation number (Ne) is 0, and the governor cut operation is performed through the logical sum processing G-5, whereby the safety of the system is further improved. Then, information on the flags THFAIL, TPSFAIL, CPSFAIL and EST of failure factors is input into a display processing block G-7 which notifies the operator of the failure information by lighting a failure display lamp 99 (see FIG. 3) as failure notification means through various systems in accordance with failure contents or the like, which facilitates the grasping of the situation of the failure or the specifying of the failure position.

Figure 4:
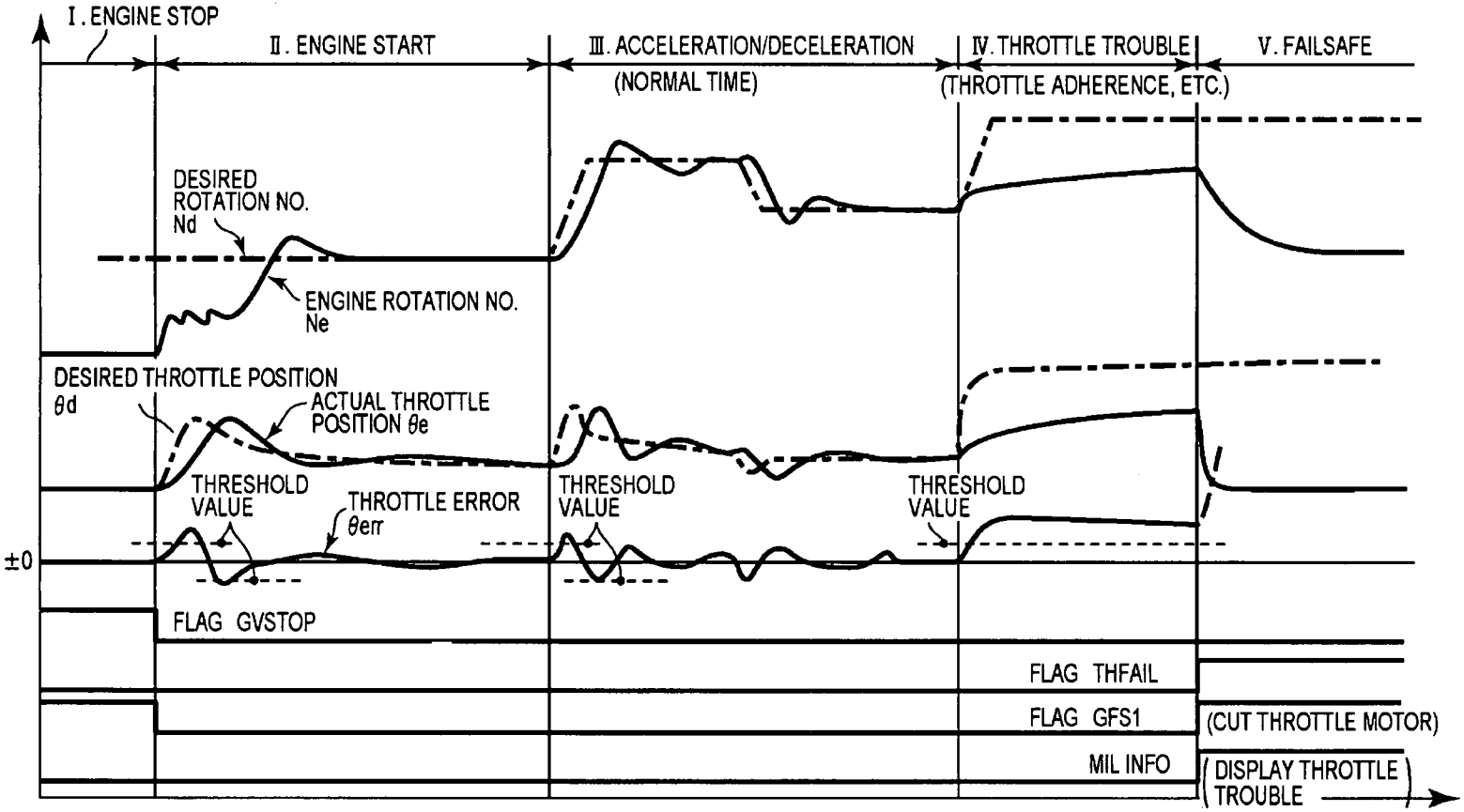
FIG. 4 is a graph showing an example of the control result of the electronic control unit of FIG. 1.

FIG. 4 is a graph showing an example of the control result of the electronic control unit 10A. First, when the engine 2 stops and the ignition key is turned on (I), the engine rotation number (Ne) is 0 [rpm]. Therefore, when the governor stop flag GVSTOP=1, the failsafe control flag GFS1 of the first stage is set to 1, and a control input into the throttle actuator 13 is 0, to cut a power source, whereby the throttle valve 32 is not inadvertently moved to prevent an erroneous operation and secure the safety.

Next, when a starter motor is driven to perform an engine start operation (II), the engine rotation number (Ne) increases to obtain the governor stop flag GVSTOP=0, and the failsafe control flag GFS1 of the first stage is reset to 0. In the control of the electronic governor system in a normal state, the desired throttle position (θd) is calculated in accordance with the desired engine rotation number (Nd), and the actual throttle position (θe) is controlled so as to converge to this desired throttle position, thereby finally performing usual control so that the engine rotation number (Nd) converges to the desired engine rotation number.

Afterward, even when the desired engine rotation number (Nd) is changed to perform an acceleration/deceleration operation (III), the throttle position (θe) is controlled so as to follow the desired engine rotation number (Nd). However, when the electronic governor system 1A is normal, the error (θerr) of the actual throttle position (θe) with respect to the desired throttle position (θd) is micro, and does not exceed the "threshold value" which is preset for the failure judgment. If the error exceeds the value, control is immediately executed so that the position converges to the desired throttle position (θd). In consequence, there continues a state where time when "the threshold value" is exceeded is not very long.

However, if a problem such as an operation defect occurs here in the throttle mechanism to worsen the operation (IV), the operation to converge to the desired throttle value (θd) is delayed, or the value cannot converge to the desired value at all. In consequence, the error (θerr) exceeds "the throttle value", and this state continues for a long time.

When this state continues for a predetermined time or longer (V), as the first stage of the failure judgment of the electronic governor system 1A, it is judged that "the throttle operation defect" has been generated, and the flag THFAIL is set to 1, to display the failure. Moreover, the failsafe control flag GFS1 of the first stage of the system is set to 1, and the control input into the throttle actuator 13 is set to 0, to cut the power source, whereby the throttle valve 32 is returned to the totally closed position only by a returning force of the return spring 36. The engine rotation number is lowered to prevent the runaway and inadvertent blow-up of the engine 2, thereby securing the safety of the system.

Figure 5:
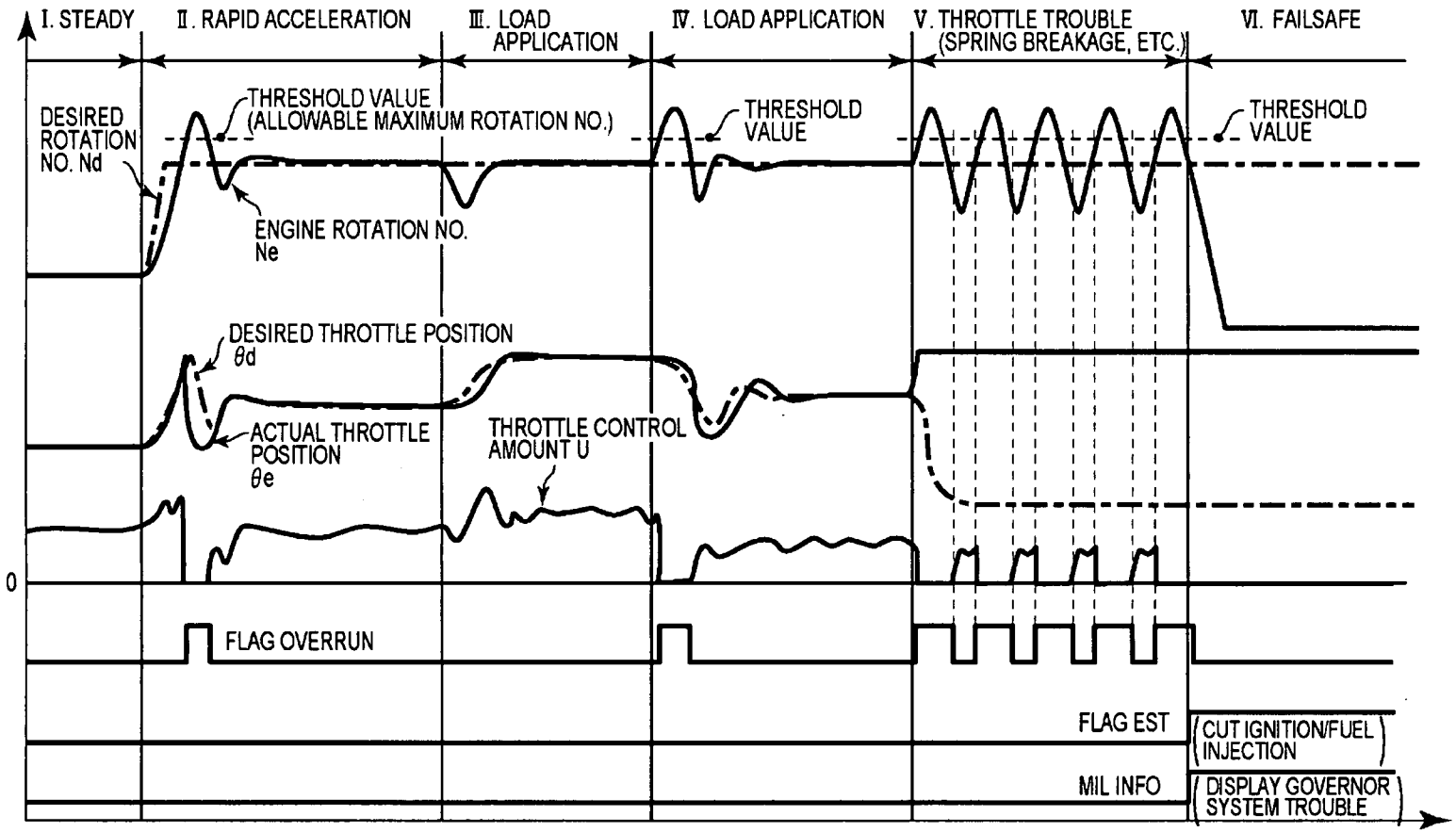
FIG. 5 is a graph showing an example of the control result of the electronic control unit of FIG. 1.

FIG. 5 is a graph showing the control result of the failure judgment and failsafe control of the second stage by the electronic governor system 1A. When the desired engine rotation number (Nd) is rapidly raised from the normal steady state (I) to obtain a rapid acceleration state (II), the engine rotation number (Ne) overshoots the desired engine rotation number (Nd). Furthermore, when the acceleration is excessively rapidly performed, the overrun flag OVERRUN is set to 1.

When the overrun flag OVERRUN is 1, the throttle control amount (U) is set to 0, to cut the power source of the throttle actuator 13, the throttle valve 32 is returned in the totally closing direction by the return spring, and the ignition and fuel injection are cut, whereby control is executed so as to prevent the overrun of the engine 2. Furthermore, when the engine rotation number (Ne) lowers to be not more than the above "threshold value", the overrun flag OVERRUN is reset to 0, thereby returning to a usual control state. In consequence, the electronic control unit 10A of the electronic governor system 1A constantly executes safety control so that the rotation number of the engine 2 does not exceed the maximum allowable rotation number.

In another similar operation example, when a large load is applied (III) and from this high load state, the load is rapidly released (IV), the engine rotation number (Ne) overshoots the desired engine rotation number sometimes. Also in this case, the overrun flag OVERRUN is exerted in the same manner as described above, and the governor cut control and ignition/fuel cut control are executed to prevent the occurrence of the engine overrun.

However, when a serious defect is generated in the throttle valve 32 and especially when there emerges a failure mode which is more serious than the above failure judgment conditions of the first stage, for example, the adherence of the throttle shaft 33, the drop-out of the valve, the breakage of the return spring or the like, a phenomenon (V) occurs in which the overrun flag OVERRUN repeats 1 and 0 and the engine rotation number (Ne) intensely hunts.

When the electronic control unit 10A experiences a state where the overrun flag OVERRUN repeats 1 and 0 in such a short time, the electronic control unit judges that "the serious defect has been generated in the system", sets the engine emergency stop flag EST to 1, completely cuts the ignition and fuel injection to emergently stop the engine 2 (VI), and notifies (displays) failure information. In consequence, the serious failure which causes engine breakdown can be prevented in advance, and the operator can instantaneously recognize the failure information to appropriately and immediately repair the failure.

Figure 6:
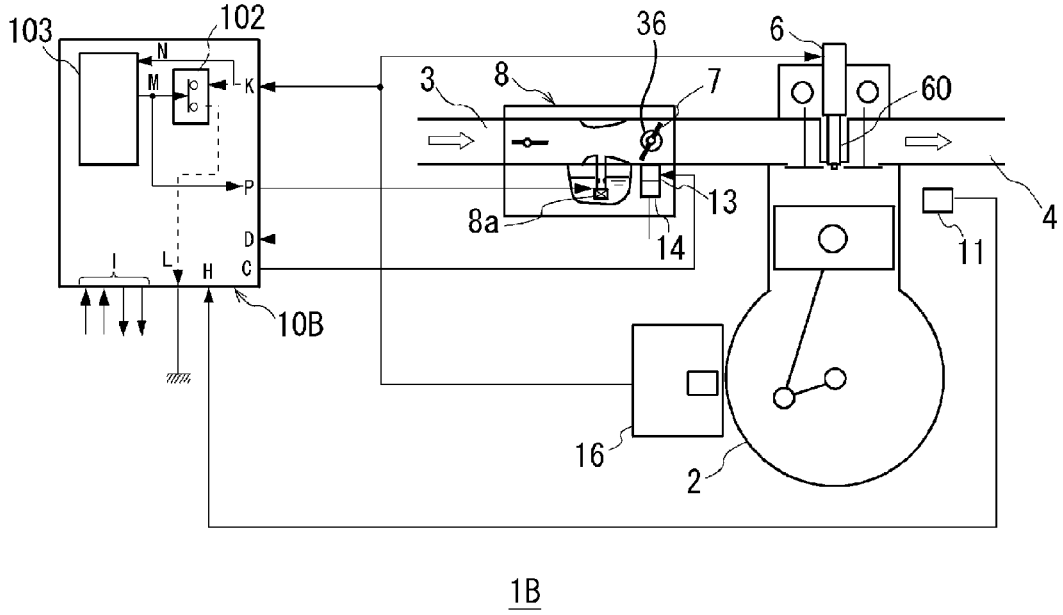
FIG. 6 is an arrangement diagram showing an application example of the electronic governor system of FIG. 1.

FIG. 6 shows, as an application example of the electronic governor system 1A, an electronic governor system 1B which uses a carburetor 8 in fuel supply means of an engine 2. Unlike a usual carburetor, the carburetor 8 is characterized in that a throttle valve 7 is provided with a throttle actuator 13 and a throttle position sensor 14 and a fuel passage is provided with a solenoid valve 8*a* for cutting a fuel.

Moreover, a magnet type igniter 16 is employed as ignition means of the engine 2, and an ignition signal generated by this igniter is transmitted to an ignition plug 60 through an ignition coil 6, thereby discharging electricity. The ignition signal is input into an electronic control unit 10B (K), and a cycle of the signal is read by a microcomputer 103, whereby the cycle is utilized as engine rotation number data. Substantially in the same manner as in the above system, electronic governor control processing is performed, and the throttle actuator 13 is driven and controlled.

Here, when the system encounters a first stage of a failure state due to the above "throttle operation defect", an output (C) from the electronic control unit 10B is set to 0 by a method similar to the above method, thereby stopping the driving of the throttle actuator 13.

Moreover, when the system encounters a second stage of the failure state due to the above "serious defect generated in the system", the microcomputer 103 turns on a fuel/ignition cut signal (M). When this signal is turned on, the input port (K) of the ignition signal is earthed to engine ground by a switch unit 102, whereby the ignition plug 60 is not ignited. Moreover, when the solenoid valve 8*a* for cutting the fuel in the carburetor 8 is closed to cut the fuel (cut a power source via a port (P)), in the same manner as in the above system, the engine 2 can emergently be stopped.

The electronic governor system 1B has the above constitution, and the electronic control unit 10B has the above control contents, whereby as compared with the conventional electronic governor system 1C, excellent control and a secure failsafe control mechanism in the system are constructed at low cost.

As described above, a first stage of failure judgment is performed on the basis of information on an error amount of throttle position control. Additionally, from an occurrence situation of the overrun of an engine, a second stage of the failure judgment is performed. In the case of the former failure judgment, a driving power source of a throttle actuator is cut to lower an engine rotation number. In the case of the latter failure judgment, a power source of an igniter or a fuel injection unit is cut to emergently stop the engine. According to the present invention, new sensors for the failure judgment do not have to be added but failure diagnosis of a system can be performed only with sensor information on the present situation. There can be provided a sufficiently safe electronic governor system.

What is claimed is:

1. An electronic governor system comprising:

an electronic control throttle including an actuator driving type throttle valve and a throttle position sensor;

an engine rotation number sensor; and a control device which performs an operation to open and close the throttle valve in accordance with an engine operation state while detecting at least an output signal from the throttle position sensor and an output signal from the engine rotation number sensor, to maintain a desired engine rotation number, wherein the control device performs a first failure judgment method to constantly monitor an error of detected throttle position data with respect to a desired throttle control value and judge that a failure of a throttle control system has occurred in a case where an absolute value of the error exceeds a predetermined threshold value continuously for a predetermined time or longer, and the control device performs a second failure judgment method to judge that a serious failure has occurred in the system in a case where a detected engine rotation number exceeds a predetermined rotation number continuously for a predetermined time or longer, to perform predetermined operations in accordance with the judgment results.

2. The electronic governor system according to claim 1, wherein during the operation in the case where it is judged by the first failure judgment method that the failure has occurred, the control device stops energization of an actuator of the throttle valve, and moves the throttle valve in a closing direction by a return spring attached to a throttle shaft, to lower the engine rotation number.

3. The electronic governor system according to claim 1, wherein during the operation in the case where it is judged by the second failure judgment method that the failure has occurred, the control device performs at least one of stop of energization of an ignition coil, stop of energization of a fuel injection valve and stop of supply of a fuel, to emergently stop the engine.

4. The electronic governor system according to claim 2, wherein during the operation in the case where it is judged by the second failure judgment method that the failure has occurred, the control device performs at least one of stop of energization of an ignition coil, stop of energization of a fuel injection valve and stop of supply of a fuel, to emergently stop the engine.

5. The electronic governor system according to claim 1, further comprising:

failure notification means, wherein during the operation in the case where it is judged that the failure has occurred, the control device notifies, via the failure notification means, an operator of at least one of the occurrence of the failure and a position of the failure.

6. The electronic governor system according to claim 2, further comprising:

failure notification means, wherein during the operation in the case where it is judged that the failure has occurred, the control device notifies, via the failure notification means, an operator of at least one of the occurrence of the failure and a position of the failure.

7. The electronic governor system according to claim 5, wherein the failure notification means is a failure display lamp, and the control device controls the energization so as to obtain a lighting situation which varies with contents of the judgment of the occurrence of the failure.

8. The electronic governor system according to claim 6, wherein the failure notification means is a failure display lamp, and the control device controls the energization so as to obtain a lighting situation which varies with contents of the judgment of the occurrence of the failure.

* * * * *